US010586502B2

(12) United States Patent
Inoue

(10) Patent No.: US 10,586,502 B2
(45) Date of Patent: Mar. 10, 2020

(54) DISPLAY CONTROL DEVICE AND DISPLAY CONTROL METHOD OF SYNCHRONIZING IMAGES UNDER PANEL SELF-REFRESH

(71) Applicant: MegaChips Corporation, Osaka (JP)

(72) Inventor: Hidefumi Inoue, Chiba (JP)

(73) Assignee: MegaChips Corporation, Osaka (JP)

( * ) Notice: Subject to any disclaimer, the term of this patent is extended or adjusted under 35 U.S.C. 154(b) by 23 days.

(21) Appl. No.: 15/943,478

(22) Filed: Apr. 2, 2018

(65) Prior Publication Data

US 2018/0286333 A1 Oct. 4, 2018

(30) Foreign Application Priority Data

Mar. 31, 2017 (JP) ..... 2017-071598

(51) Int. Cl.
*G09G 3/36* (2006.01)
*G09G 5/00* (2006.01)
*G09G 5/12* (2006.01)

(52) U.S. Cl.
CPC ..... *G09G 3/3618* (2013.01); *G09G 5/006* (2013.01); *G09G 5/12* (2013.01); *G09G 2360/18* (2013.01); *G09G 2370/045* (2013.01)

(58) Field of Classification Search
None
See application file for complete search history.

(56) References Cited

U.S. PATENT DOCUMENTS

2008/0036748 A1* 2/2008 Lees ..... G09G 5/12 345/204
2010/0164966 A1* 7/2010 Sakariya ..... G09G 3/20 345/520
2011/0157198 A1* 6/2011 Vasquez ..... G09G 5/003 345/531
2012/0147020 A1* 6/2012 Hussain ..... G06T 1/00 345/522
2014/0253537 A1* 9/2014 Lee ..... G09G 5/12 345/214

FOREIGN PATENT DOCUMENTS

JP 2007-233119 A 9/2007
JP 2015-191097 A 11/2015

* cited by examiner

*Primary Examiner* — Kee M Tung
*Assistant Examiner* — Patrick F Valdez
(74) *Attorney, Agent, or Firm* — Osha Liang LLP

(57) ABSTRACT

Provided is a display control device that can, even with a self-emitting display, minimize power consumption and dramatically increase the battery life time of information device. The display control device includes: a phase adjustment circuit that adjusts a phase difference between input image data including a vertical blanking period and memory image data read from a frame buffer, by adjusting the number of vertical blanking lines on the basis of a difference between the number of vertical lines related to the input image data and the number of vertical lines related to phase adjusted image data in which the number of vertical blanking lines related to the memory image data is adjusted, and generating the phase adjusted image data; a selector that outputs the phase adjusted image data to the display as output image data in the period lasting until image display under PSR terminates; and a vertical line number calculation circuit that outputs a vertical line number signal related to the number of vertical lines related to output image data to the display until when a head of a frame of the output image data is output.

17 Claims, 7 Drawing Sheets

DISPLAY CONTROL DEVICE AND DISPLAY CONTROL METHOD OF SYNCHRONIZING IMAGES UNDER PANEL SELF-REFRESH

BACKGROUND OF THE INVENTION

Field of the Invention

The present invention relates to a display control device and a display control method and, particularly, a display control device and a display control method which are applicable to a self-emitting display.

Description of the Related Art

In recent years, digital displays, such as liquid-crystal displays, conforming to DisplayPort, which is a video interface standard, have been popular. In particular, embedded DisplayPort (hereinafter referred to as "eDP") is a standard established considering the internal wiring of information device, and eDP v1.3 or later includes Panel Self-Refresh (hereinafter referred to as "PSR") Technology. PSR Technology, which enables screen display by using a memory in a display, can minimize power consumption and dramatically increase the battery life of an information device.

An example of technique using PSR technology is Japanese Patent Publication No. 2015-191097 in which an image display system includes a selection circuit for output to the display while switching image data, a controller for controlling the selection circuit, a transfer circuit for outputting external image data to the selection circuit and the controller as first image data, and a storage device for storing, under control by the controller, the first image data as second image data; if switching from a first output state to a second output state is confirmed while the controller outputs the second image data to the display, the proposal of the number of frames required for switching image data is calculated by multiple calculation schemes; and the period in which the second image data is not shown is adjusted based on frame information determined by the proposal.

In displays using organic light emitting diodes (OLEDs) or other self-emitting displays, a controller needs to notify, before processing of a head of a frame, of the number of vertical lines per frame (see e.g., Japanese Patent Publication No. 2007-233119).

Even with a self-emitting display, it is necessary to minimize power consumption and dramatically increase the battery life of the information device.

With PSR technology, such a conventional technique enables switching of output image without causing flicker in images but is not applicable to self-emitting displays.

An object of the present invention is to provide a display control device and a display control method that can, even with a self-emitting display, minimize power consumption and dramatically increase the battery life time of information device.

SUMMARY OF THE INVENTION

The present invention used to solve the above-described problem may include the following inventive particular matters or technical features.

Specifically, the invention according to one aspect may be a display control device for controlling image display on a display. The display control device may include a phase adjustment circuit that adjusts a phase difference between input image data including a vertical blanking period supplied from a predetermined transmission device and memory image data read from a frame buffer for PSR, by adjusting the number of vertical blanking lines related to the memory image data on the basis of a difference between the number of vertical lines related to the input image data and the number of vertical lines related to phase adjusted image data in which the number of vertical blanking lines related to the memory image data is adjusted, and generating the phase adjusted image data; a selector that selects any one of the input image data, the memory image data, and the phase adjusted image data and outputs the selected data to the display as output image data; and a vertical line number calculation circuit that calculates the number of vertical lines related to the output image data and outputs a vertical line number signal related to the calculated number of vertical lines to the display until when a head of a frame of the output image data is output to the display. The selector may select the phase adjusted image data during a period before image display under PSR on the display terminates after a lapse of a predetermined period.

The phase adjustment circuit may calculate the amount of increase/decrease in the number of vertical blanking lines related to the memory image data, and generate a vertical blanking line number increment/decrement signal related to the calculated amount of increase/decrease, and the vertical line number calculation circuit may calculate the number of vertical lines related to the output image data on the basis of the vertical blanking line number increment/decrement signal.

In addition, the vertical line number calculation circuit may include: a calculation circuit that calculates the number of vertical lines related to the phase adjusted image data in accordance with the vertical blanking line number increment/decrement signal; and an update circuit that updates the number of vertical lines related to the previous output image data on the basis of the number of vertical lines related to the phase adjusted image data calculated by the calculation circuit and outputs the number of vertical lines related to the output image data.

In addition, the phase adjustment circuit may include: a line difference calculation circuit that determines a difference between the number of vertical lines related to the input image data and the number of vertical lines related to the phase adjusted image data; an increment/decrement amount determination circuit that generates the vertical blanking line number increment/decrement signal on the basis of the difference determined by the line difference calculation circuit; and an increment/decrement circuit that increases or decreases the number of vertical blanking lines related to the memory image data in accordance with the vertical blanking line number increment/decrement signal and generates the phase adjusted image data.

In addition, the display control device may further include a PSR control circuit that generates a phase adjustment signal when control information supplied from the transmission device includes information indicating that image display under PSR on the display will terminate after a lapse of a predetermined period. Upon reception of the phase adjustment signal, the phase adjustment circuit may generate the phase adjusted image data and generate a selection signal causing the selector to select the phase adjusted image data.

The invention according to another aspect may be a display control device for controlling image display on a display. The display control device may include an adjustment calculation circuit that adjusts a phase difference between input image data including a vertical blanking period supplied from a predetermined transmission device and image data read from a frame buffer for PSR, by calculating the amount of increase/decrease in the number of vertical blanking lines related to the image data based on a difference between the number of vertical lines related to the input image data and the number of vertical lines related to adjusted image data in which the number of vertical blanking lines related to the image data is adjusted, and generating a vertical blanking line number increment/decrement signal related to the calculated amount of increase/decrease; an adjusted image generator circuit that generates the adjusted image data by adjusting the number of vertical blanking lines related to the image data on the basis of the vertical blanking line number increment/decrement signal; and a selector that selects at least one of the input image data and the adjusted image data and outputs the selected data to the display as output image data. The adjustment calculation circuit may further calculate the number of vertical lines related to the output image data and output a vertical line number signal related to the calculated number of vertical lines to the display until when a head of a frame of the output image data is output to the display. In addition, the selector may select the adjusted image data during a period before image display under PSR on the display terminates after a lapse of a predetermined period.

The invention according to another aspect may be an image display system. The image display system may include a display control device according to any one of the above-described aspects; a transmission device that outputs the input image data to the display control device; and a frame buffer for PSR.

The invention according to another aspect may be a display control method for controlling image display on a display in a display control device. The display control method may include: adjusting, in a phase adjustment circuit, a phase difference between input image data including a vertical blanking period supplied from a predetermined transmission device and memory image data read from a frame buffer for PSR, by adjusting the number of vertical blanking lines related to the memory image data on the basis of a difference between the number of vertical lines related to the input image data and the number of vertical lines related to phase adjusted image data in which the number of vertical blanking lines related to the memory image data is adjusted, and generating the phase adjusted image data; selecting, in a selector, any one of the input image data, the memory image data, and the phase adjusted image data and outputting the selected data to the display as output image data; and calculating, in a vertical line number calculation circuit, the number of vertical lines related to the output image data and outputting a vertical line number signal related to the calculated number of vertical lines to the display until when a head of a frame of the output image data is output to the display. The phase adjusted image data may be selected during a period before image display under PSR on the display terminates after a lapse of a predetermined period.

The step of generating the phase adjusted image data may include calculating the amount of increase/decrease in the number of vertical blanking lines related to the memory image data, and generating a vertical blanking line number increment/decrement signal related to the calculated amount of increase/decrease, and the step of calculating the number of vertical lines may include calculating the number of vertical lines related to the output image data on the basis of the vertical blanking line number increment/decrement signal.

In addition, the step of calculating the number of vertical lines may further include: calculating the number of vertical lines related to the phase adjusted image data in accordance with the vertical blanking line number increment/decrement signal; and updating the number of vertical lines related to the previous output image data on the basis of the number of vertical lines related to the phase adjusted image data and outputting the number of vertical lines related to the output image data.

In addition, the step of generating the phase adjusted image data may further include: determining a difference between the number of vertical lines related to the input image data and the number of vertical lines related to the phase adjusted image data; generating the vertical blanking line number increment/decrement signal on the basis of the difference determined by the line difference calculation circuit; and increasing or decreasing the number of vertical blanking lines related to the memory image data in accordance with the vertical blanking line number increment/decrement signal and generating the phase adjusted image data.

The display control method may further include the step of generating a phase adjustment signal when control information supplied from the transmission device includes information indicating that image display under PSR on the display will terminate after a lapse of a predetermined period; generating the phase adjusted image data on the basis of the supplied phase adjustment signal; and generating a selection signal causing selection of the phase adjusted image data.

The invention according to another aspect may be a display control method for controlling image display on a display in a display control device. The display control method may include: adjusting, in an adjustment calculation circuit, a phase difference between input image data including a vertical blanking period supplied from a predetermined transmission device and image data read from a frame buffer for PSR, by calculating the amount of increase/decrease in the number of vertical blanking lines related to the image data on the basis of a difference between the number of vertical lines related to the input image data and the number of vertical lines related to adjusted image data in which the number of vertical blanking lines related to the image data is adjusted, and generating a vertical blanking line number increment/decrement signal related to the calculated amount of increase/decrease; generating, in an adjusted image generator circuit, the adjusted image data by adjusting the number of vertical blanking lines related to the image data on the basis of the vertical blanking line number increment/decrement signal; selecting, in a selector, the input image data or the adjusted image data and outputting the selected data to the display as output image data; and, in the adjustment calculation circuit, calculating the number of vertical lines related to the output image data and outputting a vertical line number signal related to the calculated number of vertical lines to the display until when the head of the frame of the output image data is output to the display. The selector may select the adjusted image data during a period before image display under PSR on the display terminates after a lapse of a predetermined period.

The present invention can provide a display control device and a display control method that can, even with a self-emitting display, minimize power consumption and dramatically increase the battery life time of information device.

Other technical features, objects, and effects or advantages of the present invention will be clarified by the following embodiments described with reference to the attached drawings.

DETAILED DESCRIPTION OF THE PREFERRED EMBODIMENTS

Figure 1:
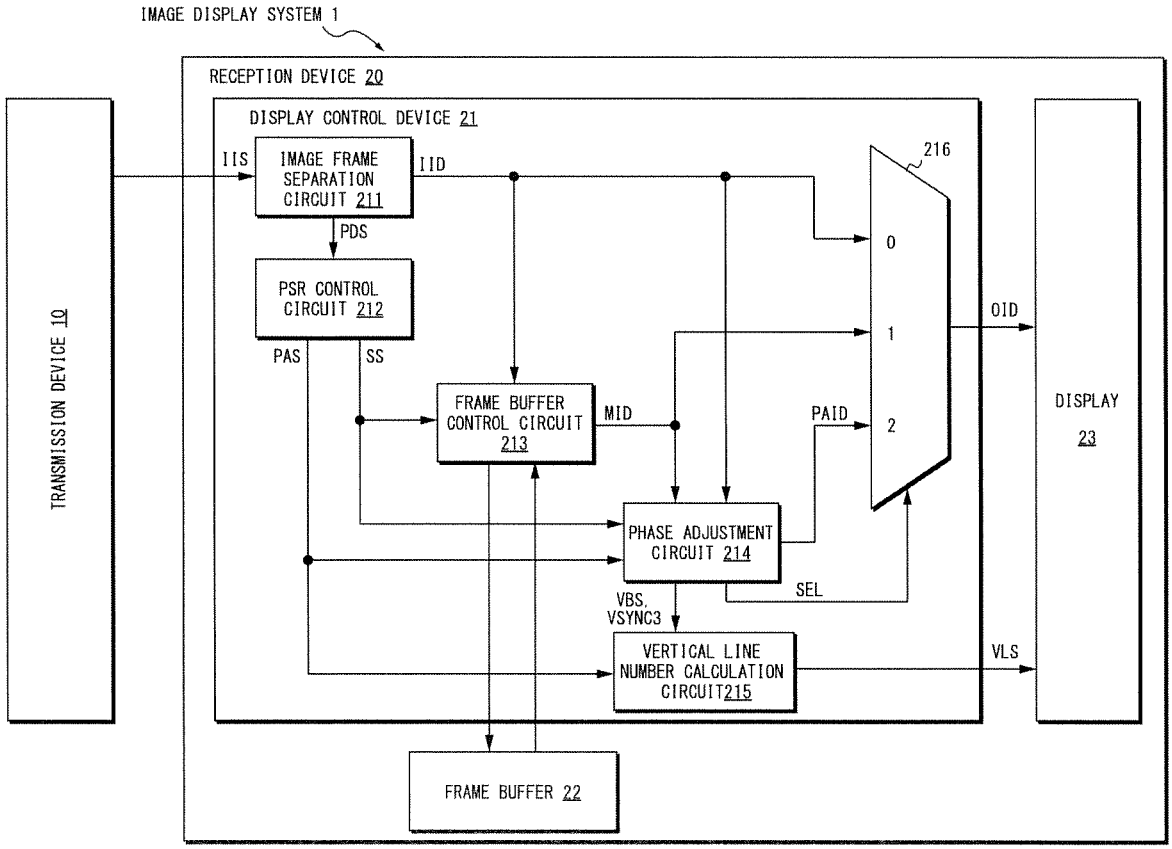
FIG. 1 is a block diagram for illustrating an image display system according to one embodiment of the present invention.

An embodiment of the present invention will now be described with reference to drawings. It should be noted that the following embodiments are merely illustrative and is given without eliminating various modifications and technique applications which are not explicitly shown below. The present invention can be implemented with various modifications (e.g., a combination of embodiments) unless otherwise departing from the scope of the invention. In the drawings, the same or similar components may be denoted by the same or similar reference numeral. The drawings show schematic representations and do not necessarily show actual sizes or ratios. There may be a difference in size or ratio between drawings.

First Embodiment

FIG. 1 is a block diagram for illustrating an image display system according to one embodiment of the present invention. As shown in the figure, an image display system 1 according to this embodiment may include, for example, a transmission device 10 and a reception device 20.

The transmission device 10 may be a source device of eDP, which may be, but not limited to, a personal computer, for example.

The reception device 20 may be a sink device of eDP, which may be, but not limited to, an OLED display or other self-emitting displays, for example. The reception device 20 may include, for example, a display control device 21, a frame buffer 22, and a display 23.

The display control device 21 may generate output image data OID and a vertical line number signal VLS on the basis of an input image frame signal IIS supplied from the transmission device 10, and output them to the display 23. In this embodiment, the display control device 21 may include, for example, an image frame separation circuit 211, a PSR control circuit 212, a frame buffer control circuit 213, a phase adjustment circuit 214, a vertical line number calculation circuit 215, and a selector 216. It should be noted that output image data OID may include a vertical synchronization signal VSYNC, a horizontal synchronization signal HSYNC, a data enabling signal DE, and an image data signal ID.

The image frame separation circuit 211 may separate various information contained in the input image frame signal IIS supplied from the transmission device 10, and may generate input image data IID and a PSR data signal PDS. The input image data IID may contain a first vertical synchronization signal VSYNC 1, a first horizontal synchronization signal HSYNC 1, a first data enabling signal DE 1, and a first image data signal ID 1. The PSR data signal PDS may contain control information related to PSR technology. The image frame separation circuit 211 may output the generated input image data IID to the frame buffer control circuit 213, the phase adjustment circuit 214, and the selector 216. The image frame separation circuit 211 may output the generated PSR data signal PDS to the PSR control circuit 212.

The PSR control circuit 212 may generate a state signal SS and a phase adjustment signal PAS based on the PSR data signal PDS supplied from the image frame separation circuit 211. The state signal SS may be a signal that is in a first state (e.g., "H") when an image based on the PSR technology is displayed on the display 23. The phase adjustment signal PAS may be a signal that is in a first state (e.g., "H") during display of an image based on the PSR technology on the display 23 in a predetermined period (hereinafter referred to as a "PSR Exit period"). The PSR control circuit 212 may output the generated state signal SS to the frame buffer control circuit 213 and the phase adjustment circuit 214 and may output the generated phase adjustment signal PAS to the phase adjustment circuit 214 and the vertical line number calculation circuit 215.

The frame buffer control circuit 213 may write data, which is based on the input image data IID supplied from the image frame separation circuit 211, into the frame buffer 22. Upon reception of the state signal SS from the PSR control circuit 212, the frame buffer control circuit 213 may read various data from the frame buffer 22, and may output memory image data MID based on the various data to the phase adjustment circuit 214 and the selector 216. It should be noted that the memory image data MID may contain a second vertical synchronization signal VSYNC 2, a second horizontal synchronization signal HSYNC 2, a second data enabling signal DE 2, and a second image data signal ID 2.

The phase adjustment circuit 214 may generate a phase adjusted image data PAID, a selection signal SEL, and a vertical blanking line number increment/decrement signal VBS on the basis of the input image data IID supplied from the image frame separation circuit 211, the memory image data MID supplied from the frame buffer control circuit 213, and the state signal SS and phase adjustment signal PAS supplied from the PSR control circuit 212. The phase adjusted image data PAID may be generated to adjust a phase difference between the input image data IID and the memory image data MID, and may contain a third vertical synchronization signal VSYNC 3, a third horizontal synchronization signal HSYNC 3, a third data enabling signal DE 3, and a third image data signal ID 3. The selection signal SEL may be a signal that allows the selector 216 to select the input image data IID, the memory image data MID, or the phase adjusted image data PAID. The vertical blanking line number increment/decrement signal VBS may be a signal that indicates the amount of increase/decrease in the number of vertical blanking lines related to the memory image data MID.

The phase adjustment circuit 214 may output the generated phase adjusted image data PAID and selection signal SEL to the selector 216. The phase adjustment circuit 214 may output the vertical blanking line number increment/decrement signal VBS and the third vertical synchronization signal VSYNC 3 to the vertical line number calculation circuit 215. It should be noted that the details of the phase adjustment circuit 214 will be described later.

The vertical line number calculation circuit 215 may generate the vertical line number signal VLS based on the phase adjustment signal PAS supplied from the PSR control circuit 212, and the vertical blanking line number increment/decrement signal VBS and third vertical synchronization signal VSYNC 3 supplied from the phase adjustment circuit 214. The vertical line number signal VLS may indicate the number of vertical lines related to the output image data OID output from the selector 216. The vertical line number calculation circuit 215 may output the generated vertical line number signal VLS to the display 23. The details of the vertical line number calculation circuit 215 will be described later.

The selector 216 may select any one of the input image data IID supplied from the image frame separation circuit 211, the memory image data MID supplied from the frame buffer control circuit 213, and the phase adjusted image data PAID supplied from the phase adjustment circuit 214, in accordance with the selection signal SEL from the phase adjustment circuit 214. In this embodiment, if the selection signal SEL has a value of "0" (hereinafter referred to as selection signal SEL "0"), the selector 216 may select the input image data IID. If the selection signal SEL has a value of "1" (hereinafter referred to as selection signal SEL "1"), the selector 216 may select the memory image data MID. If the selection signal SEL has a value of "2" (hereinafter referred to as selection signal SEL "2"), the selector 216 may select the phase adjusted image data PAID. The selector 216 may output any one of the selected input image data IID, the memory image data MID, and the phase adjusted image data PAID to the display 23 as the output image data OID.

The frame buffer 22 may be provided to implement the PSR technology included in eDP v1.3 or later and may be a memory for storing still image data. In this embodiment, the frame buffer 22 may store the input image data IID output from the frame buffer control circuit 213. Further, the frame buffer 22 may output the data stored therein to the frame buffer control circuit 213.

The display 23 may be, but not limited to, an OLED display, for example. In this embodiment, the display 23 may show an image related to the output image data OID supplied from the selector 216. It should be noted that the display 23 may be, but not necessarily, provided in the reception device 20 in this example. The display 23 may be separated from the reception device 20.

Figure 2:
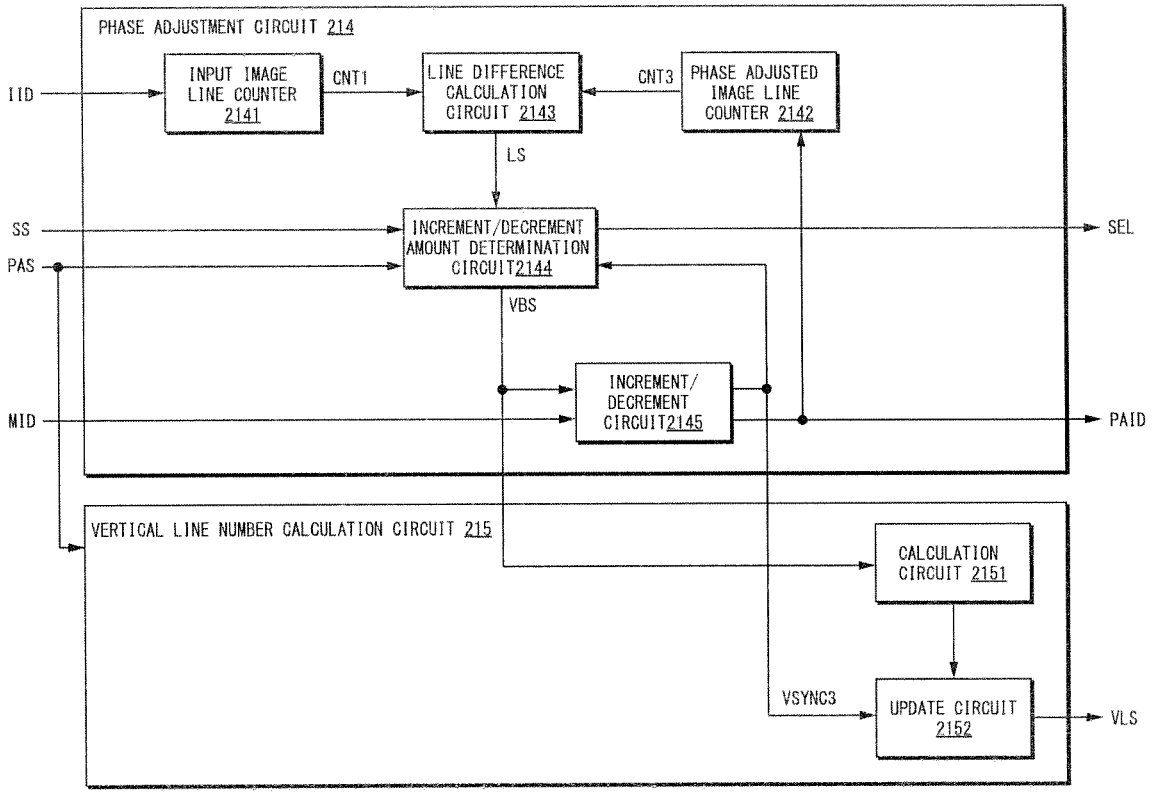
FIG. 2 is a block diagram for illustrating a phase adjustment circuit and a vertical line number calculation circuit according to one embodiment of the present invention.

FIG. 2 is a block diagram for illustrating a phase adjustment circuit and a vertical line number calculation circuit according to one embodiment of the present invention. As shown in the figure, the phase adjustment circuit 214 according to this embodiment may include, for example, an input image line counter 2141, a phase adjusted image line counter 2142, a line difference calculation circuit 2143, an increment/decrement amount determination circuit 2144, and an increment/decrement circuit 2145. The vertical line number calculation circuit 215 according to this embodiment may include, for example, a calculation circuit 2151 and an update circuit 2152.

The input image line counter 2141 may count the number of vertical lines related to the input image data IID supplied from the image frame separation circuit 211. The input image line counter 2141 may output a first count signal CNT 1 indicating the number of vertical lines related to the input image data IID to the line difference calculation circuit 2143.

The phase adjusted image line counter 2142 may calculate the number of vertical lines related to the phase adjusted image data PAID supplied from the increment/decrement circuit 2145. The phase adjusted image line counter 2142 may output a third count signal CNT 3 indicating the number of vertical lines related to the phase adjusted image data PAID to the line difference calculation circuit 2143.

The line difference calculation circuit 2143 may determine a difference between the number of vertical lines related to the input image data IID and the number of vertical lines related to the phase adjusted image data PAID based on the first count signal CNT 1 supplied from the input image line counter 2141 and the third count signal CNT 3 supplied from the phase adjusted image line counter 2142. The line difference calculation circuit 2143 may indicate the determined difference, that is, may output the line difference signal LS, which indicates the difference between the number of vertical lines related to the input image data IID and the number of vertical lines related to the phase adjusted image data PAID, to the increment/decrement amount determination circuit 2144.

The increment/decrement amount determination circuit 2144 may determine the amount of increase/decrease in the number of vertical blanking lines related to the memory image data MID on the basis of the line difference signal LS supplied from the line difference calculation circuit 2143. In this embodiment, the increment/decrement amount determination circuit 2144 may determine, for each frame, the amount of increase/decrease in the number of vertical blanking lines related to the memory image data MID such that a difference between the number of vertical lines related to the input image data IID and the number of vertical lines related to the phase adjusted image data PAID equal to or less than a predetermined threshold during the PSR Exit period. For example, the increment/decrement amount determination circuit 2144 may determine the incrementable maximum value and the decrementable maximum value of vertical blanking lines related to the memory image data MID for one frame, in accordance with a set value read from a register which is not shown in the drawing. The increment/decrement amount determination circuit 2144 may then determine, for each frame, the amount of increase/decrease in the number of vertical blanking lines related to the memory image data MID, within the range between the incrementable maximum value and the decrementable maximum value of vertical blanking lines related to the memory image data MID, in such a manner that the difference between the number of vertical lines related to the input image data IID and the number of vertical lines related to the memory image data MID becomes small. The increment/decrement amount determination circuit 2144 may output the determined amount of increase/decrease in the number of vertical blanking lines for each frame to the increment/decrement circuit 2145 and the calculation circuit 2151, as the vertical blanking line number increment/decrement signal VBS.

The increment/decrement amount determination circuit 2144 may generate the selection signal SEL based on the state signal SS and the phase adjustment signal PAS supplied from the PSR control circuit 212 and the third vertical synchronization signal VSYNC 3 supplied from the increment/decrement circuit 2145, and may output it to the selector 216. In this embodiment, if the state signal SS and the phase adjustment signal PAS are both in the second state (e.g., "L") (this state is hereinafter referred to as the "normal state"), the increment/decrement amount determination circuit 2144 may generate the selection signal SEL "0," synchronize it with the third vertical synchronization signal V SYNC 3, and output it to the selector 216. If only the state signal SS is in the first state (e.g., "H") (this state is hereinafter referred to as the "PSR period"), the phase adjustment circuit 214 may generate the selection signal SEL "1," synchronize it with the third vertical synchronization signal VSYNC 3, and output it to the selector 216. If the state signal SS and the phase adjustment signal PAS are both in the first state (e.g., "H"), that is, in the PSR Exit period, the phase adjustment circuit 214 may generate the selection signal SEL "2," synchronize it with the third vertical synchronization signal VSYNC 3, and output it to the selector 216. If the difference between the number of vertical lines related to the input image data IID and the number of vertical lines related to the phase adjusted image data PAID equal to or less than a predetermined threshold during the PSR Exit period, the increment/decrement amount determination circuit 2144 may generate the selection signal SEL "0," synchronize it with the third vertical synchronization signal VSYNC 3, and output it to the selector 216.

The increment/decrement circuit 2145 may adjust the number of vertical blanking lines related to the memory image data MID supplied from the frame buffer control circuit 213 on the basis of the vertical blanking line number increment/decrement signal VBS supplied from the increment/decrement amount determination circuit 2144, output it to the selector 216 and the phase adjusted image line counter 2142 as the phase adjusted image data PAID, and output the third vertical synchronization signal VSYNC 3 contained in the phase adjusted image data PAID to the increment/decrement amount determination circuit 2144 and the update circuit 2152.

The calculation circuit 2151 may calculate a signal indicating the number of vertical lines related to the phase adjusted image data PAID on the basis of the vertical blanking line number increment/decrement signal VBS supplied from the increment/decrement amount determination circuit 2144, and output it to the update circuit 2152. In this embodiment, the calculation circuit 2151 may have a predetermined initial value, and may calculate a signal indicating the number of vertical lines related to the phase adjusted image data PAID by updating the initial value on the basis of the vertical blanking line number increment/decrement signal VBS supplied from the increment/decrement amount determination circuit 2144.

The update circuit 2152 may generate the vertical line number signal VLS indicating the number of vertical lines related to the output image data OID, and output it on the display 23 on the head of the frame of the output image data OID. When the number of vertical lines related to the phase adjusted image data PAID supplied from the calculation circuit 2151 is different from the current number of vertical lines, the update circuit 2152 may generate the vertical line number signal VLS on the basis of data showing the number of vertical lines related to the phase adjusted image data PAID, synchronize it with the third vertical synchronization signal VSYNC 3 supplied from the increment/decrement circuit 2145, and output it to the display 23.

Figure 3:
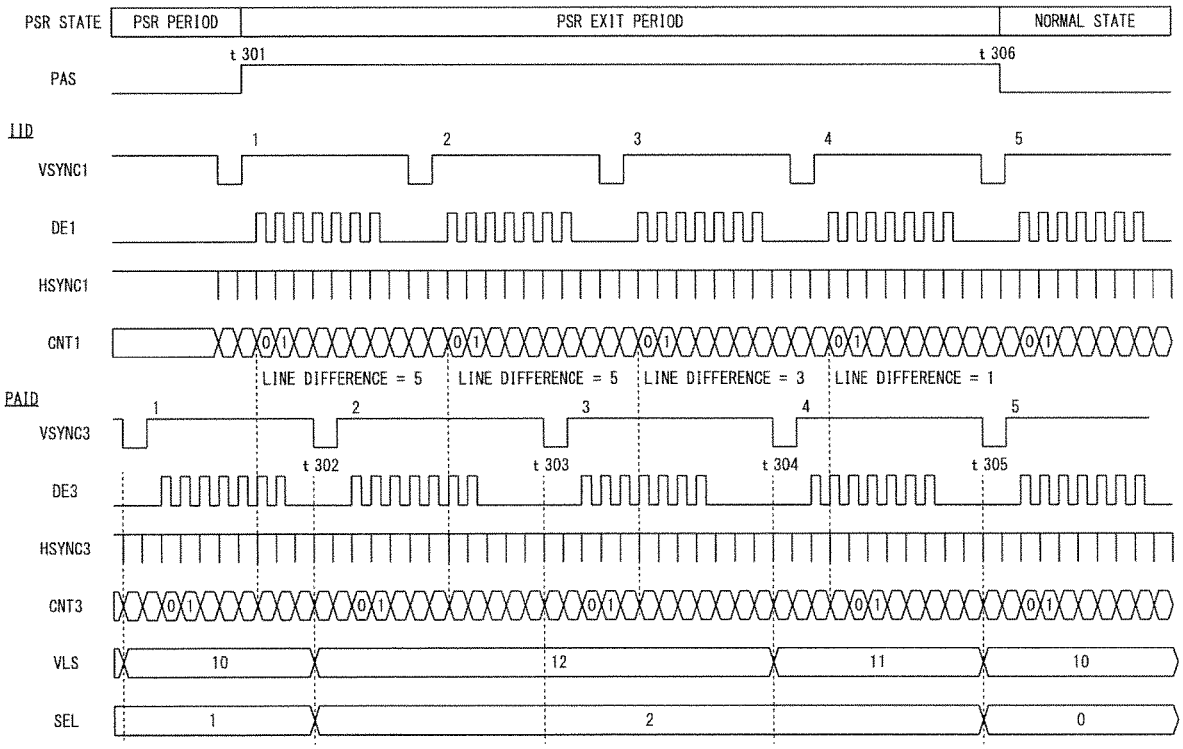
FIG. 3 is a timing chart illustrating behavior of each component of an image display system according to one embodiment of the present invention.

FIG. 3 is a timing chart illustrating behavior of each component of an image display system according to one embodiment of the present invention. In the drawing, the period up to the time t301 may be the PSR period, the period from the time t301 to the time t306 may be the PSR Exit period, and the period from the time t306 may correspond to the normal state.

Referring to the figure, since the PSR data signal PDS may include information indicating that image display based on the PSR technology on the display 23 terminates after the PSR Exit period, the PSR control circuit 212 may generate the phase adjustment signal PAS that is in the first state (e.g., "H") over the period from the time t301 to the time t306. The PSR control circuit 212 may output the generated phase adjustment signal PAS to the increment/decrement amount determination circuit 2144 and the vertical line number calculation circuit 215. Further, the PSR control circuit 212 may generate the state signal SS that is in the first state (e.g., "H") over the period up to the time t306, in which the image based on the PSR technology is displayed on the display 23, and is in the second state (e.g., "L") after the time t306. The PSR control circuit 212 may output the generated state signal SS to the frame buffer control circuit 213 and the increment/decrement amount determination circuit 2144.

The image frame separation circuit 211 may separate various signals contained in the input image frame signal IIS supplied from the transmission device 10, generate the input image data IID, and output it to the frame buffer control circuit 213, the input image line counter 2141, and the selector 216. The input image data IID may contain a first vertical synchronization signal VSYNC 1, a first data enabling signal DE 1, a first horizontal synchronization signal HSYNC 1, and a first image data signal ID 1 which are shown in the drawing.

The input image line counter 2141 may count the number of vertical lines related to the input image data IID per frame. In this embodiment, after the first vertical synchronization signal VSYNC 1 makes a transition to the second state (e.g., "L"), the input image line counter 2141 may count the number of vertical lines related to the input image data IID, regarding the time at which the first data enabling signal DE 1 first goes into the first state (e.g., "H") as a line 0, and output it as the first count signal CNT 1. The input image line counter 2141 may count the number of vertical lines related to the input image data IID, with the first horizontal synchronization signal HSYNC 1 serving as a trigger.

The increment/decrement circuit 2145 may adjust the number of times of blanking in the memory image data MID supplied from the frame buffer control circuit 213, on the basis of the vertical blanking line number increment/decrement signal VBS supplied from the increment/decrement amount determination circuit 2144, and output it to the selector 216 or the like as the phase adjusted image data PAID. The phase adjusted image data PAID during the PSR period may be data equivalent to the memory image data MID, and include the third vertical synchronization signal VSYNC 3, the third data enabling signal DE 3, the third horizontal synchronization signal HSYNC 3, and the like as shown in the figure.

The phase adjusted image line counter 2142 may count the number of vertical lines related to the phase adjusted image data PAID per image frame. In this embodiment, after the third vertical synchronization signal VSYNC 3 makes a transition to the second state (e.g., "L"), the phase adjusted image line counter 2142 may count the number of vertical lines related to the phase adjusted image data PAID, regarding the time at which the third data enabling signal DE 3 goes into the first state (e.g., "H") as a line 0, and output it as the third count signal CNT 3. The phase adjusted image line counter 2142 may count the number of vertical lines related to the phase adjusted image data PAID, with the third horizontal synchronization signal HSYNC 3 serving as a trigger.

The line difference calculation circuit 2143 may determine a difference between the number of vertical lines related to the input image data IID and the number of vertical lines related to the phase adjusted image data PAID on the basis of the first count signal CNT 1 supplied from the input image line counter 2141 and the third count signal CNT 3 supplied from the phase adjusted image line counter 2142, and output it as the line difference signal LS.

The increment/decrement amount determination circuit 2144 may determine, for each frame, the amount of increase/decrease in the number of vertical blanking lines related to the memory image data MID such that a difference between the number of vertical lines related to the input image data IID and the number of vertical lines related to the phase adjusted image data PAID becomes equal to or less than a predetermined threshold during the PSR Exit period.

As shown in the figure, at the time t301, the first state (e.g., "H") for the phase adjustment signal PAS is supplied from the PSR control circuit 212 and the state signal SS is in the first state (e.g., "H"), so that the increment/decrement amount determination circuit 2144 may synchronize it with VSYNC 3 for a transition of the selection signal SEL from the selection signal SEL "1" to the selection signal SEL "2" at the time t302. Accordingly, the selector 216 may select the phase adjusted image data PAID and output it to the display 23 as the output image data OID, and the display 23 may therefore display an image based on the phase adjusted image data PAID.

In this embodiment, at the time t302, in view of the fact that the difference between the number of vertical lines related to the input image data IID and the number of vertical lines related to the phase adjusted image data PAID, i.e., the line difference signal LS is 5, the increment/decrement amount determination circuit 2144 may determine to increase the number of vertical blanking lines related to the memory image data MID. The amount of increase in this example may be "2" which is a preset value. The increment/decrement amount determination circuit 2144 may generate the vertical blanking line number increment/decrement signal VBS (=+2) indicating the determined value, and output it to the increment/decrement circuit 2145 and the calculation circuit 2151.

Accordingly, the increment/decrement circuit 2145 may generate the phase adjusted image data PAID in which the number of vertical blanking lines related to the memory image data MID is increased by two from the initial value, and output it to the selector 216 as the second frame. The increment/decrement circuit 2145 may increase the period of VSYNC 3 by two lines by increasing the number of lines by two in the second frame. Further, at the time t302, the calculation circuit 2151 may determine a signal indicating the number of vertical lines related to the phase adjusted image data PAID to be 12, in accordance with the vertical blanking line number increment/decrement signal VBS supplied from the increment/decrement amount determination circuit 2144, i.e., an instruction to increase by two, and the initial value of 10 of the number of vertical lines. It should be noted that the calculation circuit 2151 may store the number of vertical lines in the normal state as the initial value of the number of vertical lines. At the time t302, in accordance with a signal indicating the number of vertical lines related to the phase adjusted image data PAID supplied from the calculation circuit 2151, i.e., 12, the update circuit 2152 may output the vertical line number signal VLS in which the value has been updated from 10 to 12 to the display 23.

Subsequently, at the time t303, in view of the fact that the difference between the number of vertical lines related to the input image data IID and the number of vertical lines related to the phase adjusted image data PAID, i.e., the line difference signal LS is 5, the increment/decrement amount determination circuit 2144 may determine to increase the number of vertical blanking lines related to the memory image data MID by two. At the time t303, since the period of the third vertical synchronization signal VSYNC 3 may be increased by two, the count value of the phase adjusted image line counter 2142, i.e., the third count signal CNT 3 may be increased by two from that at the time t302, although the line difference may not change because the counting for the second frame may start after the time t302. The increment/decrement amount determination circuit 2144 may generate the vertical blanking line number increment/decrement signal VBS (=+2) indicating the determined value. To be specific, in the third frame, the increment/decrement amount determination circuit 2144 may generate the vertical blanking line number increment/decrement signal VBS (=+2) indicating the fact that the number of vertical blanking lines related to the memory image data MID is increased by two. The increment/decrement amount determination circuit 2144 may output the generated vertical blanking line number increment/decrement signal VBS (=+2) to the increment/decrement circuit 2145 and the calculation circuit 2151.

Accordingly, the increment/decrement circuit 2145 may generate the phase adjusted image data PAID in which the number of vertical blanking lines related to the memory image data MID is increased by four from the initial value, and output it to the selector 216 as the third frame, by summation of the vertical blanking line number increment/decrement signal VBS supplied from the increment/decrement amount determination circuit 2144. Further, at the time t303, the calculation circuit 2151 may determine a signal indicating the number of vertical lines related to the phase adjusted image data PAID to be 12, in accordance with the vertical blanking line number increment/decrement signal VBS supplied from the increment/decrement amount determination circuit 2144, i.e., an instruction to increase by two, and the initial value of 10 of the number of vertical lines. At the time t303, in view of the fact that the signal indicating the number of vertical lines related to the phase adjusted image data PAID supplied from the calculation circuit 2151 does not change (remains to be 12), the update circuit 2152 may output the vertical line number signal VLS to the display 23 without updating its value.

Subsequently, at the time t304, in view of the fact that the difference between the number of vertical lines related to the input image data IID and the number of vertical lines related to the phase adjusted image data PAID, i.e., the line difference signal LS is 3, the increment/decrement amount determination circuit 2144 may determine to increase the number of vertical blanking lines related to the memory image data MID by one. At the time t304, the period of VSYNC 3 may not change from the previous time but the difference in the numbers of vertical lines determined from the count value provided by the phase adjusted image line counter 2142, i.e., the line difference signal LS may be three which is reduced from that at the time t303 by two, which may be because counting starts after the time t303. The increment/decrement amount determination circuit 2144 may generate the vertical blanking line number increment/decrement signal VBS (=+1) indicating the determined value. To be specific, in the fourth frame, the increment/decrement amount determination circuit 2144 may generate the vertical blanking line number increment/decrement signal VBS (=+1) indicating the fact that the number of vertical blanking lines related to the memory image data MID is increased by one. The increment/decrement amount determination circuit 2144 may output the generated vertical blanking line number increment/decrement signal VBS (=+1) to the increment/decrement circuit 2145 and the calculation circuit 2151.

Accordingly, the increment/decrement circuit 2145 may generate the phase adjusted image data PAID in which the number of vertical blanking lines related to the memory image data MID is increased by five from the initial value, and output it to the selector 216 as the fourth frame, by summation of the vertical blanking line number increment/decrement signal VBS supplied from the increment/decrement amount determination circuit 2144. Further, at the time t304, the calculation circuit 2151 may determine a signal indicating the number of vertical lines related to the phase adjusted image data PAID to be 11, in accordance with the vertical blanking line number increment/decrement signal VBS supplied from the increment/decrement amount determination circuit 2144, i.e., an instruction to increase by one, and the initial value of 10 of the number of vertical lines. At the time t304, in view of the fact that the signal indicating the number of vertical lines related to the phase adjusted image data PAID supplied from the calculation circuit 2151 has changed (=11), the update circuit 2152 may update the value of the vertical line number signal VLS to 11 and output it to the display 23.

Subsequently, at the time t305, the difference between the number of vertical lines related to the input image data IID and the number of vertical lines related to phase adjusted image data PAID may become the line difference signal LS=1, which is equal to or less than the predetermined threshold. Here, suppose that the predetermined threshold may be two. The increment/decrement amount determination circuit 2144 may change the selection signal SEL from the selection signal SEL "2" to the selection signal SEL "0." Further, at the time t305, the increment/decrement amount determination circuit 2144 may generate the vertical blanking line number increment/decrement signal VBS (=0) which indicates the fact that the number of vertical blanking lines is not increased or decreased. Further, at the time t305, the calculation circuit 2151 may determine a signal indicating the number of vertical lines related to the phase adjusted image data PAID to be 10, in accordance with the vertical blanking line number increment/decrement signal VBS supplied from the increment/decrement amount determination circuit 2144 (=0), and the initial value of 10 of the number of vertical lines. At the time t305, in view of the fact that the signal indicating the number of vertical lines related to the phase adjusted image data PAID supplied from the calculation circuit 2151 has changed (=10), the update circuit 2152 may update the value of the vertical line number signal VLS to 10 and output it to the display 23. Thus, the display 23 may show an image based on the input image data IID after the time t306.

In addition, the phase adjustment signal PAS supplied from the PSR control circuit 212 to the increment/decrement amount determination circuit 2144 and the vertical line number calculation circuit 215 may be in the second state (e.g., "L").

As described above, during the PSR Exit period, the image display system 1 may generate the phase adjusted image data PAID in which the number of vertical lines related to the memory image data MID is adjusted, in order to adjust the phases of the input image data IID and the memory image data MID, and not only output it to the display 23 as output image data OID but also output the vertical line number signal VLS indicating the number of vertical lines related to that output image data OID to the display 23 on the head of the frame after the output image data OID. Hence, even if the display 23 is a self-emitting display, such as an OLED display, the image display system 1 may allow an image based on the phase adjusted image data PAID to be displayed on the display 23 during the PSR Exit period. Further, the image display system 1 may allow an image based on the input image data IID to be displayed on the display 23 immediately after the transition from the PSR Exit period to the normal state without causing flickers and the like.

Figure 4:
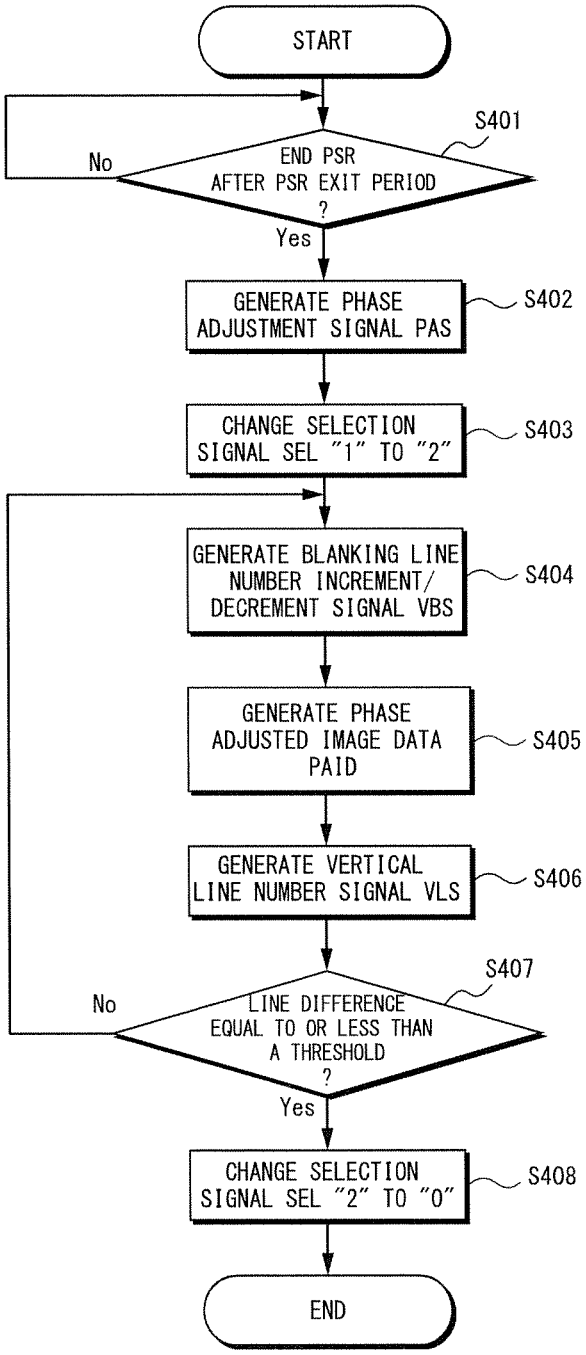
FIG. 4 is a flow chart for illustrating a display control method according to one embodiment of the present invention.

FIG. 4 is a flow chart for illustrating a display control method according to one embodiment of the present invention. The display control method may be implemented in the image display system 1.

As shown in the figure, the PSR control circuit 212 may determine whether the PSR data signal PDS contains information indicating that image display based on the PSR technology on the display 23 terminates after the PSR Exit period (S401). If the PSR data signal PDS contains the information (Yes in S401), the PSR control circuit 212 may generate the phase adjustment signal PAS, and output it to the increment/decrement amount determination circuit 2144 and the vertical line number calculation circuit 215 (S402). In contrast, if the PSR data signal PDS does not contain the information (No in S401), the PSR control circuit 212 may go on standby.

Subsequently, the increment/decrement amount determination circuit 2144 may change the selection signal SEL from the selection signal SEL "1" to the selection signal SEL "2," synchronize it with the third vertical synchronization signal VSYNC 3 supplied from the increment/decrement circuit 2145, and output it to the selector 216 (S403). Accordingly, the selector 216 may select the phase adjusted image data PAID and output it to the display 23 as the output image data OID.

Subsequently, the increment/decrement amount determination circuit 2144 may determine the amount of increase/decrease in the number of vertical blanking lines related to the memory image data MID such that a difference between the number of vertical lines related to the input image data IID and the number of vertical lines related to the phase adjusted image data PAID becomes equal to or less than a predetermined threshold during the PSR Exit period (S404). In this embodiment, the increment/decrement amount determination circuit 2144 may determine the amount of increase/decrease in the number of vertical blanking lines related to the memory image data MID within the range between the incrementable maximum value and the decrementable maximum value of vertical blanking lines for one frame, such that the value of the line difference signal LS indicating the difference between the number of vertical lines related to the input image data IID and the number of vertical lines related to the phase adjusted image data PAID supplied from the line difference calculation circuit 2143 becomes equal to or less than a predetermined threshold during the PSR Exit period. The increment/decrement amount determination circuit 2144 may generate the vertical blanking line number increment/decrement signal VBS indicating the determined amount of increase/decrease. The increment/decrement amount determination circuit 2144 may output the generated vertical blanking line number increment/decrement signal VBS to the increment/decrement circuit 2145 and the calculation circuit 2151.

Subsequently, the increment/decrement circuit 2145 may adjust the number of vertical blanking lines related to the memory image data MID on the basis of the vertical blanking line number increment/decrement signal VBS supplied from the increment/decrement amount determination circuit 2144 by using a value summed with the amount of increase/decrease determined in the previous or former time, thereby generating the phase adjusted image data PAID (S405). The increment/decrement circuit 2145 may output the generated phase adjusted image data PAID to the selector 216 and the phase adjusted image line counter 2142, and output the third vertical synchronization signal VSYNC 3 contained in the phase adjusted image data PAID to the increment/decrement amount determination circuit 2144 and the update circuit 2152.

Subsequently, the update circuit 2152 may update the vertical line number signal VLS indicating the number of vertical lines related to the output image data OID on the basis of a signal indicating the number of vertical lines related to the phase adjusted image data PAID supplied from the calculation circuit 2151 (S406). The update circuit 2152 may output, to the display 23, the updated vertical line number signal VLS in synchronization with the third vertical synchronization signal VSYNC 3 supplied from the increment/decrement circuit 2145. To be specific, the update circuit 2152 may output the vertical line number signal VLS to the display 23, on the head of the frame of the output image data OID (phase adjusted image data PAID).

Subsequently, the line difference calculation circuit 2143 may determine whether a difference between the number of vertical lines related to the input image data IID and the number of vertical lines related to the phase adjusted image data PAID is equal to or less than a predetermined threshold (S407). If it is determined that the difference between the number of vertical lines related to the input image data IID and the number of vertical lines related to the phase adjusted image data PAID is equal to or less than the predetermined threshold (Yes in S407), the line difference calculation circuit 2143 may cause a change from the selection signal SEL "2" to the selection signal SEL "0," output it to the selector 216, and end the process (S408). Accordingly, the selector 216 may select the input image data IID and output it to the display 23 as the output image data OID. In contrast, if it is determined that the difference between the number of vertical lines related to the input image data IID and the number of vertical lines related to the memory image data MID exceeds the threshold (No in S407), the line difference calculation circuit 2143 may return to Step S404 and continue the process.

Second Embodiment

Figure 5:
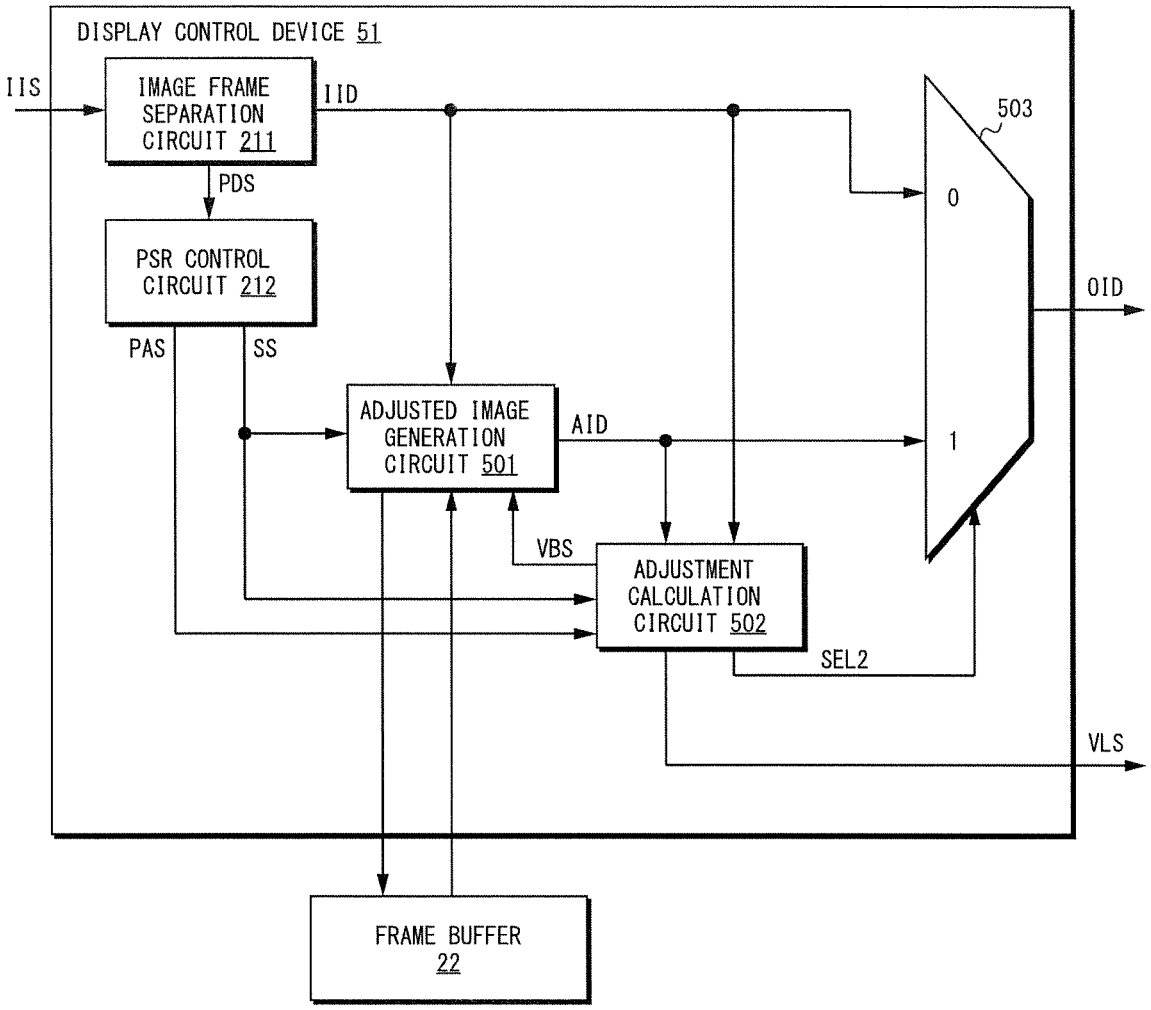
FIG. 5 is a block diagram for illustrating a display control device according to one embodiment of the present invention.

FIG. 5 is a block diagram for illustrating a display control device according to one embodiment of the present invention. As shown in the figure, a display control device 51 may be the same as the above-described display control device 21 except that it excludes the frame buffer control circuit 213, the phase adjustment circuit 214, the vertical line number calculation circuit 215, and the selector 216 and additionally includes an adjusted image generator circuit 501, an adjustment calculation circuit 502, and a second selector 503.

The adjusted image generator circuit 501 may write data, which is based on the input image data IID supplied from the image frame separation circuit 211, into the frame buffer 22. Upon reception of the state signal SS from the PSR control circuit 212, the adjusted image generator circuit 501 may read various data from the frame buffer 22. Further, the adjusted image generator circuit 501 may adjust the number of vertical blanking lines related to the image data based on various data read from the frame buffer 22, on the basis of the vertical blanking line number increment/decrement signal VBS supplied from the adjustment calculation circuit 502, and output it to the second selector 503 and the adjustment calculation circuit 502 as adjusted image data AID. It should be noted that the number of vertical blanking lines may be adjusted by adjusting the timings of when various data are read from the frame buffer 22. The adjusted image data AID may contain a fourth vertical synchronization signal VSYNC 4, a fourth horizontal synchronization signal HSYNC 4, a fourth data enabling signal DE 4, and a fourth image data signal ID 4.

The adjustment calculation circuit 502 may generate a second selection signal SEL 2, the vertical blanking line number increment/decrement signal VBS, and the vertical line number signal VLS on the basis of the input image data IID supplied from the image frame separation circuit 211, the adjusted image data AID supplied from the adjusted image generator circuit 501, and the state signal SS and phase adjustment signal PAS supplied from the PSR control circuit 212. The vertical blanking line number increment/decrement signal VBS may be generated to adjust the phase difference between the input image data IID and the image data based on various data read from the frame buffer 22. The second selection signal SEL 2 may be a signal that allows the second selector 503 to select the input image data IID or the adjusted image data AID.

The adjustment calculation circuit 502 may output the generated second selection signal SEL 2 to the second selector 503. Further, the adjustment calculation circuit 502 may output the generated vertical blanking line number increment/decrement signal VBS to the adjusted image generator circuit 501. Moreover, the adjustment calculation circuit 502 may output the generated vertical line number signal VLS to the display 23. It should be noted that the details of the adjustment calculation circuit 502 will be described later.

The second selector 503 may select the input image data IID supplied from the image frame separation circuit 211 or the adjusted image data AID supplied from the adjusted image generator circuit 501 in accordance with the second selection signal SEL 2 supplied from the adjustment calculation circuit 502. In this embodiment, if the second selection signal SEL 2 has a value of "0," the second selector 503 may select the input image data IID. If the second selection signal SEL 2 has a value of "1," the second selector 503 may select the adjusted image data AID. The second selector 503 may output the selected input image data IID or adjusted image data AID to the display 23 as the output image data OID.

Figure 6:
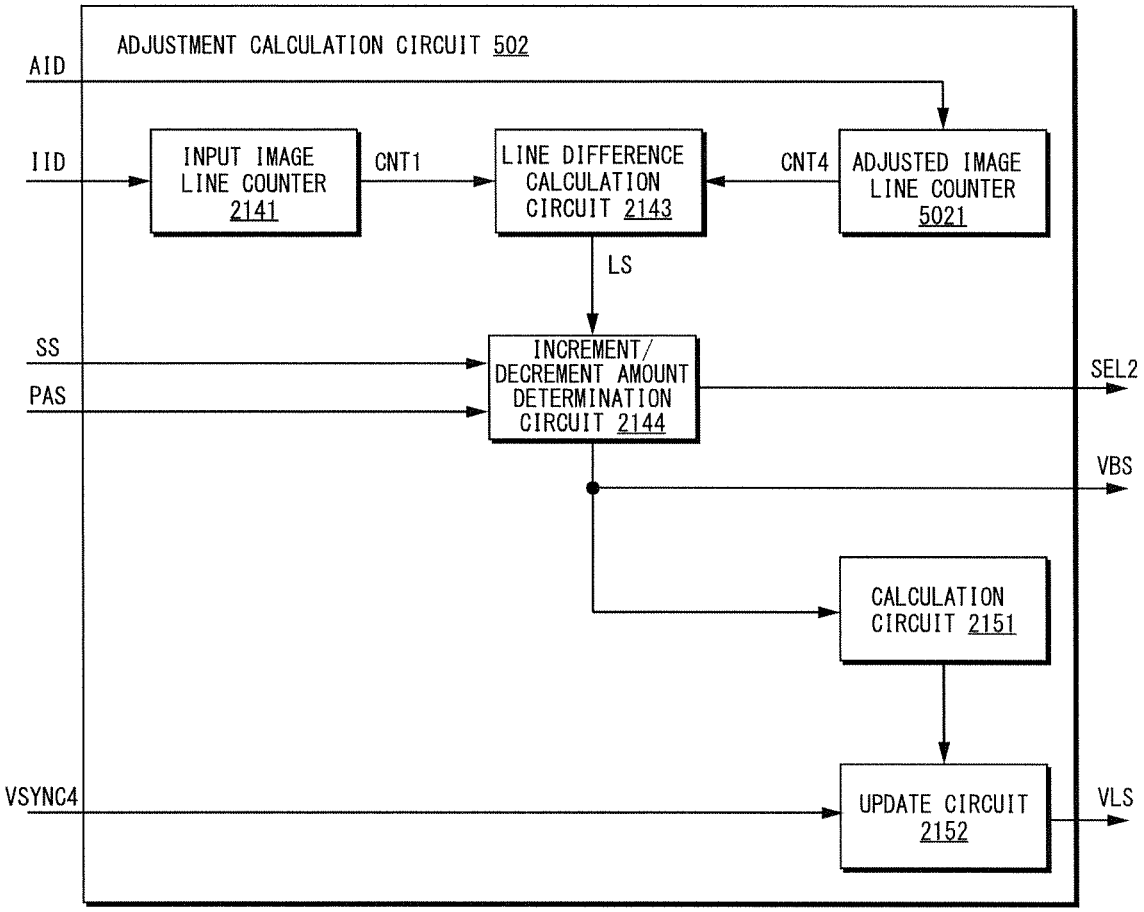
FIG. 6 is a block diagram for illustrating an adjustment calculation circuit according to one embodiment of the present invention.

FIG. 6 is a block diagram for explaining an adjustment calculation circuit according to one embodiment of the present invention. As shown in the figure, in the adjustment calculation circuit 502 according to this embodiment, the above-described phase adjustment circuit 214 and vertical line number calculation circuit 215 may be combined, the phase adjusted image line counter 2142 may be replaced with an adjusted image line counter 5021, and the phase adjusted image line counter 2142 and the increment/decrement circuit 2145 may be removed. In this embodiment, the function of the increment/decrement circuit 2145 may be included in the adjusted image generator circuit 501.

The adjusted image line counter 5021 may count the number of vertical lines related to the adjusted image data AID supplied from the adjusted image generator circuit 501. The adjusted image line counter 5021 may output a fourth count signal CNT 4 indicating the number of vertical lines related to the adjusted image data AID to the line difference calculation circuit 2143.

Accordingly, the line difference calculation circuit 2143 may determine a difference between the number of vertical lines related to the input image data IID and the number of vertical lines related to the adjusted image data AID on the basis of the first count signal CNT 1 supplied from the input image line counter 2141 and the fourth count signal CNT 4 supplied from the adjusted image line counter 5021, and output the line difference signal LS indicating the determined difference to the increment/decrement amount determination circuit 2144. The increment/decrement amount determination circuit 2144 may determine, for each frame, the amount of increase/decrease in the number of vertical blanking lines related to the memory image data MID on the basis of the line difference signal LS supplied from the line difference calculation circuit 2143, and output the vertical blanking line number increment/decrement signal VBS indicating that amount of increase/decrease to the calculation circuit 2151 and the adjusted image generator circuit 501.

The display control device 51 may have an advantage over the display control device 21 in that its circuit size can be reduced.

Third Embodiment

Figure 7:
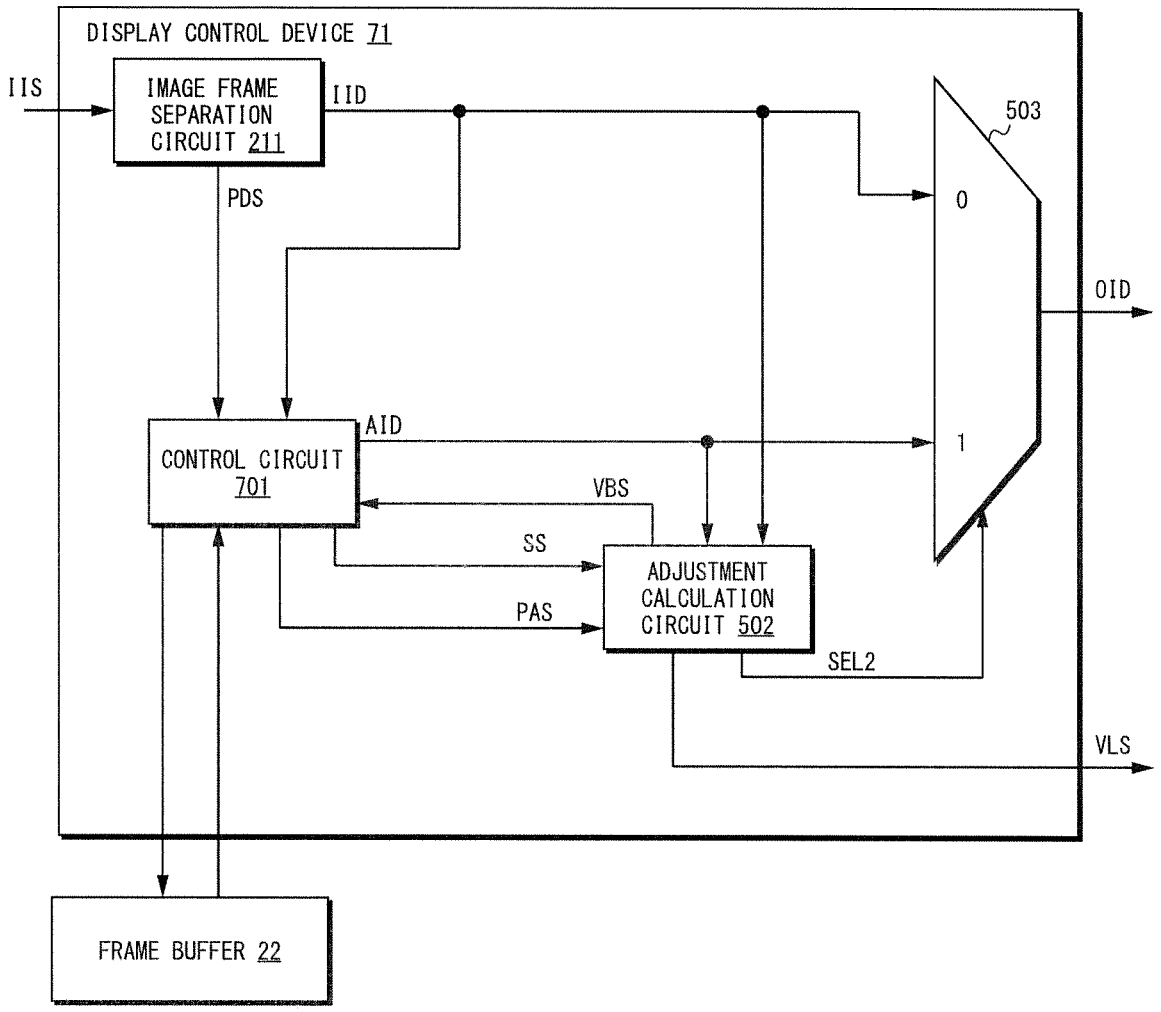
FIG. 7 is a block diagram for illustrating a display control device according to one embodiment of the present invention.

FIG. 7 is a block diagram for illustrating a display control device according to one embodiment of the present invention. As shown in the figure, the display control device 71 may be the same as the display control device 51 except that it excludes the PSR control circuit 212 and the adjusted image generator circuit 501 and additionally includes a control circuit 701.

The control circuit 701 may generate the state signal SS and the phase adjustment signal PAS on the basis of the PSR data signal PDS supplied from the image frame separation circuit 211 and output it to the adjustment calculation circuit 502. The control circuit 701 may write data, which is based on the input image data IID supplied from the image frame separation circuit 211, into the frame buffer 22. Further, the control circuit 701 may read various data from the frame buffer 22. Still further, the control circuit 701 may adjust the number of vertical blanking lines related to the image data based on various data read from the frame buffer 22, on the basis of the vertical blanking line number increment/decrement signal VBS supplied from the adjustment calculation circuit 502, and output it to the second selector 503 as the adjusted image data AID.

The display control device 71 may have an advantage over the display control device 51 in that its circuit size can be further reduced.

The above embodiments may be mere examples for explaining the present invention, and the present invention may not be limited to only these embodiments. The present invention can be implemented in various embodiments without departing from the scope of the invention.

For example, although a display showing a frame image in which a group of pixels arranged in the horizontal direction constitutes a group of lines in the vertical direction is used for explanation in this disclosure, this is not necessarily the case and a display showing a frame image in which a group of pixels arranged in the vertical direction constitutes a group of lines in the horizontal direction may be used instead.

Although various embodiments are disclosed in the specifications, a specific feature (technical matter) in one embodiment can be added to another embodiment with an appropriate improvement, or can be replaced with a specific feature in the other embodiment, and the resulting embodiment may be included in the scope of the present invention.

INDUSTRIAL APPLICABILITY

The present invention can be widely used in the field of image display systems.

What is claimed is:

1. A display control device for controlling image display on a display, comprising:

a phase adjustment circuit that adjusts a phase difference between input image data including a vertical blanking period supplied from a predetermined transmission device and memory image data read from a frame buffer for panel self-refresh (PSR), by adjusting a number of vertical blanking lines related to the memory image data based on a difference between a number of vertical blanking lines related to the input image data and a number of vertical blanking lines related to phase adjusted image data in which the number of vertical blanking lines related to the memory image data is adjusted, and generating the phase adjusted image data;

a multiplexer that selects any one of the input image data, the memory image data, and the phase adjusted image data and outputs the selected data to the display as output image data; and a vertical line number calculation circuit that calculates a number of vertical blanking lines related to the output image data and outputs a vertical line number signal related to the calculated number of vertical blanking lines related to the output image data to the display until a head of a frame of the output image data is output to the display, wherein the multiplexer selects the phase adjusted image data during a period before image display under PSR on the display terminates, after a lapse of a predetermined period.

2. The display control device according to claim 1, wherein the phase adjustment circuit calculates an amount of increase/decrease in the number of vertical blanking lines related to the memory image data, and generates a vertical blanking line number increment/decrement signal related to the amount of increase/decrease, and the vertical line number calculation circuit calculates a number of vertical blanking lines related to the output image data based on a vertical blanking line number increment/decrement signal.

3. The display control device according to claim 2, wherein the vertical line number calculation circuit comprises:

a calculation circuit that calculates the number of vertical blanking lines related to the phase adjusted image data in accordance with the vertical blanking line number increment/decrement signal; and an update circuit that updates the number of vertical blanking lines related to the output image data reflecting a previous output image data based on the number of vertical blanking lines related to the phase adjusted image data calculated by the calculation circuit and outputs the number of vertical blanking lines related to the output image data.

4. The display control device according to claim 2, wherein the phase adjustment circuit comprises:

a line difference calculation circuit that determines a difference between the number of vertical blanking lines related to the input image data and the number of vertical blanking lines related to the phase adjusted image data;

an increment/decrement amount determination circuit that generates the vertical blanking line number increment/decrement signal based on the difference determined by the line difference calculation circuit; and an increment/decrement circuit that increases or decreases the number of vertical blanking lines related to the memory image data in accordance with the vertical blanking line number increment/decrement signal and generates the phase adjusted image data.

5. The display control device according to claim 1, further comprising a PSR control circuit that generates a phase adjustment signal when control information supplied from the transmission device includes information indicating that image display under PSR on the display terminates, after a lapse of the predetermined period, wherein upon reception of the phase adjustment signal, the phase adjustment circuit generates the phase adjusted image data and generates a selection signal causing the multiplexer to select the phase adjusted image data.

6. An image display system comprising:

the display control device according to claim 1;

a transmission device that outputs the input image data to the display control device; and a frame buffer for PSR.

7. A display control device for controlling image display on a display, comprising:

an adjustment calculation circuit that, in a predetermined period subsequent to a panel self-refresh (PSR) period, adjusts a phase difference between input image data including a vertical blanking period supplied from a predetermined transmission device just after the PSR period and image data read from a frame buffer for PSR, by calculating an amount of increase/decrease in a number of vertical blanking lines related to the image data based on a difference between a number of vertical blanking lines related to the input image data and a number of vertical blanking lines related to adjusted image data in which the number of vertical blanking lines related to the image data is adjusted, and generating a vertical blanking line number increment/decrement signal related to the calculated amount of increase/decrease;

an adjusted image generator circuit that generates the adjusted image data by adjusting the number of vertical blanking lines related to the image data based on a vertical blanking line number increment/decrement signal; and a multiplexer that selects at least one of the input image data and the adjusted image data and outputs the selected data to the display as output image data, wherein the adjustment calculation circuit further calculates a number of vertical blanking lines related to the output image data and outputs a vertical line number signal related to the calculated number of vertical blanking lines related to the output image data to the display until a head of a frame of the output image data is output to the display.

8. The display control device according to claim 7, wherein the multiplexer selects the adjusted image data during a period before image display under PSR on the display terminates, after a lapse of the predetermined period.

9. An image display system comprising:

the display control device according to claim 7;

a transmission device that outputs the input image data to the display control device; and a frame buffer for PSR.

10. The display control device according to claim 7, wherein the amount of increase/decrease in the number of vertical blanking lines is less than or equal to a predetermined threshold during the predetermined period.

11. A display control method for controlling image display on a display in a display control device, comprising:

adjusting a phase difference between input image data including a vertical blanking period supplied from a predetermined transmission device and memory image data read from a frame buffer for panel self-refresh (PSR), by adjusting a number of vertical blanking lines related to the memory image data based on a difference between a number of vertical blanking lines related to the input image data and a number of vertical blanking lines related to phase adjusted image data in which the number of vertical blanking lines related to the memory image data is adjusted, and generating the phase adjusted image data;

selecting any one of the input image data, the memory image data, and the phase adjusted image data and outputting the selected data to the display as output image data; and calculating a number of vertical blanking lines related to the output image data and outputting a vertical line number signal related to the calculated number of vertical blanking lines related to the output image data to the display until a head of a frame of the output image data is output to the display, wherein the phase adjusted image data is selected during a period before image display under PSR on the display terminates, after a lapse of a predetermined period.

12. The display control method according to claim 11, wherein the step of generating the phase adjusted image data comprises calculating an amount of increase/decrease in the number of vertical blanking lines related to the memory image data, and generating a vertical blanking line number increment/decrement signal related to the calculated amount of increase/decrease, and the step of calculating the number of vertical blanking lines comprises calculating the number of vertical blanking lines related to the output image based on a vertical blanking line number increment/decrement signal.

13. The display control method according to claim 12, wherein the step of generating the phase adjusted image data further comprises:

determining a difference between the number of vertical blanking lines related to the input image data and the number of vertical blanking lines related to the phase adjusted image data;

generating the vertical blanking line number increment/decrement signal based on the difference; and increasing or decreasing the number of vertical blanking lines related to the memory image data in accordance with the vertical blanking line number increment/decrement signal and generating the phase adjusted image data.

14. The display control method according to claim 11, wherein the step of calculating the number of vertical blanking lines further comprises:

calculating the number of vertical blanking lines related to the phase adjusted image data in accordance with the vertical blanking line number increment/decrement signal; and updating the number of vertical blanking lines related to a previous output image data based on the number of vertical blanking lines related to the phase adjusted image data and outputting the number of vertical blanking lines related to the output image data.

15. The display control method according to claim 11, wherein the method further comprises the step of generating a phase adjustment signal when control information supplied from the transmission device includes information indicating that image display under PSR on the display terminates after a lapse of the predetermined period, and the step of generating the phase adjusted image data further comprises, upon reception of the phase adjustment signal, generating the phase adjusted image data and generating a selection signal causing selection of the phase adjusted image data.

16. A display control method for controlling image display on a display in a display control device, comprising:

adjusting a phase difference between input image data including a vertical blanking period supplied from a predetermined transmission device and image data read from a frame buffer for panel self-refresh (PSR), in a predetermined period subsequent to a PSR period, by calculating an amount of increase/decrease in a number of vertical blanking lines related to the image data based on a difference between a number of vertical blanking lines related to the input image data and a number of vertical blanking lines related to adjusted image data in which the number of vertical blanking lines related to the image data is adjusted, and generating a vertical blanking line number increment/decrement signal related to the amount of increase/decrease;

generating the adjusted image data by adjusting the number of vertical blanking lines related to the image data based on a vertical blanking line number increment/decrement signal;

selecting at least one of the input image data and the adjusted image data and outputting selected data to the display as output image data;

calculating a number of vertical blanking lines related to the output image data; and outputting a vertical line number signal related to the calculated number of vertical blanking lines related to the output image data to the display until a head of a frame of the output image data is output to the display.

17. The display control method according to claim 16, wherein the adjusted image data is selected during a period before image display under PSR on the display terminates, after a lapse of the predetermined period.

* * * * *